US007600935B2

(12) United States Patent
Koba et al.

(10) Patent No.: US 7,600,935 B2
(45) Date of Patent: Oct. 13, 2009

(54) IMAGE FORMING APPARATUS WITH GEAR ARRANGEMENT FOR RESIST ROLLER AND COVER

(75) Inventors: Eiji Koba, Fukuoka (JP); Shinichiro Tsunematsu, Fukuoka (JP); Hirofumi Nakamura, Fukuoka (JP)

(73) Assignee: Panasonic Corporation, Osaka (JP)

( * ) Notice: Subject to any disclaimer, the term of this patent is extended or adjusted under 35 U.S.C. 154(b) by 760 days.

(21) Appl. No.: 11/433,463

(22) Filed: May 15, 2006

(65) Prior Publication Data

US 2006/0269350 A1 Nov. 30, 2006

(30) Foreign Application Priority Data

May 16, 2005 (JP) ..... P. 2005-142658
Mar. 16, 2006 (JP) ..... P. 2006-072346

(51) Int. Cl.
*B41J 11/00* (2006.01)

(52) U.S. Cl. ..... 400/579; 475/330; 475/331

(58) Field of Classification Search ..... 400/579; 475/331

See application file for complete search history.

(56) References Cited

U.S. PATENT DOCUMENTS 5,017,033 A * 5/1991 Hermann et al. ..... 400/693
5,160,128 A * 11/1992 Oishi ..... 271/114
5,378,201 A * 1/1995 Lee et al. ..... 474/77
5,393,152 A * 2/1995 Hattori et al. ..... 400/691
5,897,111 A * 4/1999 Jean et al. ..... 271/4.08
7,381,145 B2 * 6/2008 Watanabe et al. ..... 475/221

FOREIGN PATENT DOCUMENTS

JP 9-216747 8/1997

OTHER PUBLICATIONS

English Language Abstract of JP 9-216747.

* cited by examiner

*Primary Examiner*—Jill E Culler
(74) *Attorney, Agent, or Firm*—Greenblum & Bernstein P.L.C.

(57) ABSTRACT

An image forming apparatus has a planetary gear mechanism that transmits driving force from a driving motor to a resist roller when a cover is closed, and that stops transmitting the driving force to the resist roller when the cover is opened. The planetary gear mechanism includes a first gear to which the driving force from the driving motor is transmitted; a second gear that transmits the driving force to the resist roller; a planetary gear provided between the first and second gears; and a third gear that transmits the driving force from the first gear to the second gear via the planetary gear when the ratchet gear is locked by a lever, and that disconnects the transmission of the driving force to the resist roller when the ratchet gear is not locked.

15 Claims, 12 Drawing Sheets

IMAGE FORMING APPARATUS WITH GEAR ARRANGEMENT FOR RESIST ROLLER AND COVER

BACKGROUND OF THE INVENTION

1. Field of the Invention

The present invention relates to an image forming apparatus that allows easy fixing of a paper jam, particularly to an image forming apparatus, such as a copier, a facsimile machine, a printer, and the like.

2. Description of Related Art

A conventional image forming apparatus has a paper transport mechanism, as described in Japanese Patent Laid-open Publication Hei 9-216747, that includes: a plurality of rollers, which feed paper for image transfer; and a driving unit, which drives the rollers. FIG. 11 shows meshing of a planetary gear in forward rotation in the driving unit of the conventional paper transport mechanism. FIG. 12 shows meshing of the planetary gear in reverse rotation in the driving unit of the conventional paper transport mechanism.

As shown in FIGS. 11 and 12, driving unit 60 that transmits rotation driving force to the plurality of rollers has planetary gear 61 movable along guide slot 62. When driving motor 63 rotates in a forward direction, planetary gear 61 moves in an R direction along guide slot 62 (FIG. 11) and engages gear 64, so as to rotate and drive gear 64, which transmits the rotation driving force to the rollers, in a paper feed direction. When driving motor 63 rotates in a reverse direction (FIG. 12), planetary gear 61 moves in an S direction along guide slot 62 and disengages gear 64, so as to allow gear 64 to rotate freely. Provided at an engagement and disagreement position of planetary gear 61 and gear 64 is resisting plate 65 and bias spring 66, which allow retention of the position.

It is troublesome to fix a paper jam that occurs in the image forming apparatus since it is required to open a cover of the image forming apparatus, rotate driving motor 63 in the reverse direction for a certain amount, and disengage planetary gear 61 and gear 64 so as to release gear 64 for free rotation.

Further, when the driving unit as described above has a gear that rotates in both forward and reverse directions, instead of the planetary gear, it is required to rotate not only the gear, but also the driving motor and a plurality of gears disposed between the gear and the driving motor, in order to pull out the jammed paper from the image forming apparatus after opening the cover thereof. Therefore, removing the jammed paper requires a substantially large pull force, thus not allowing an operator to easily handle the paper jam.

SUMMARY OF THE INVENTION

An object of the present invention is to provide an image forming apparatus that allows easy removal of paper jammed therein by simply opening a cover without performing extra operation.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Figure 1:
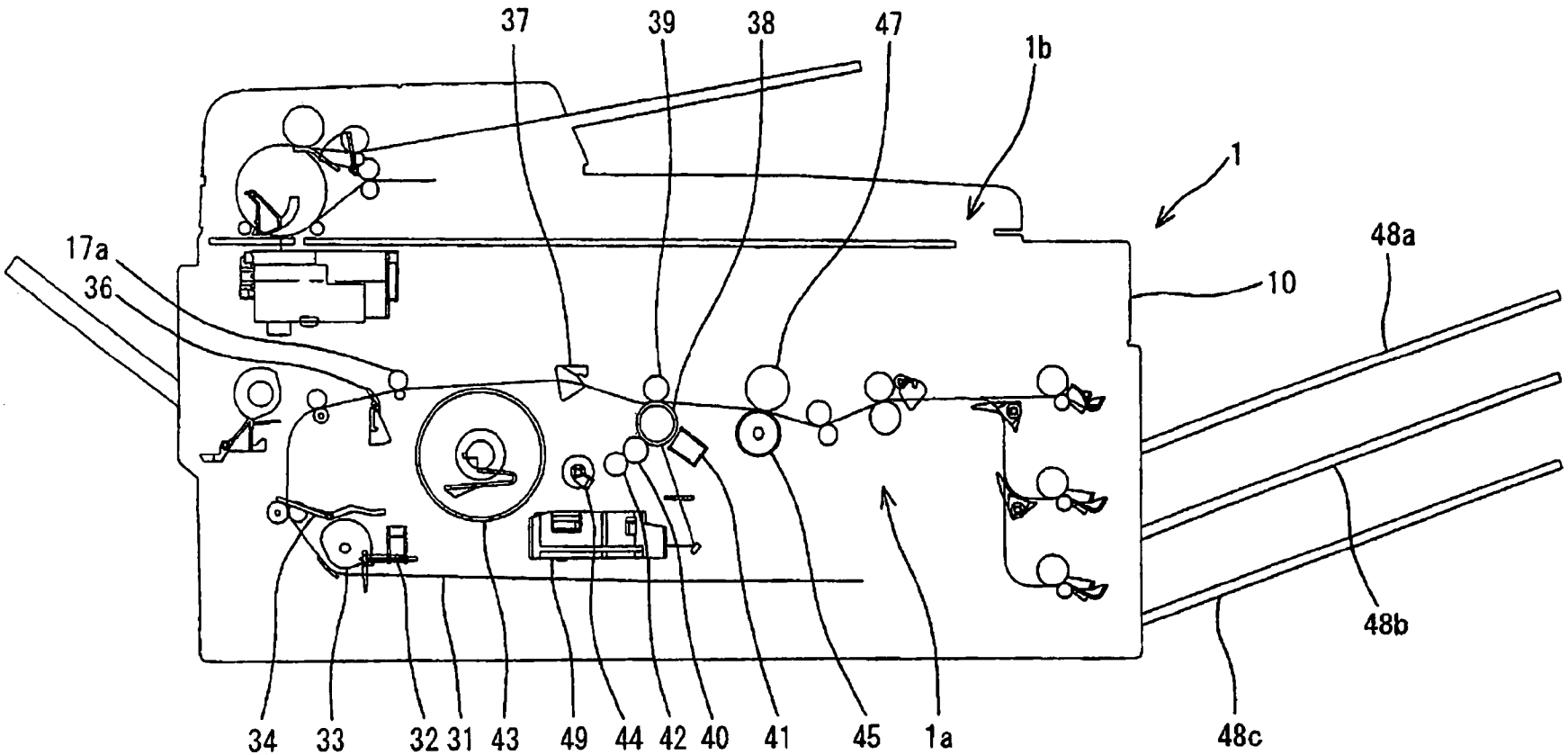
FIG. 1 is a general overall view of a paper path in an image forming apparatus according to an embodiment of the present invention.
Figure 2:
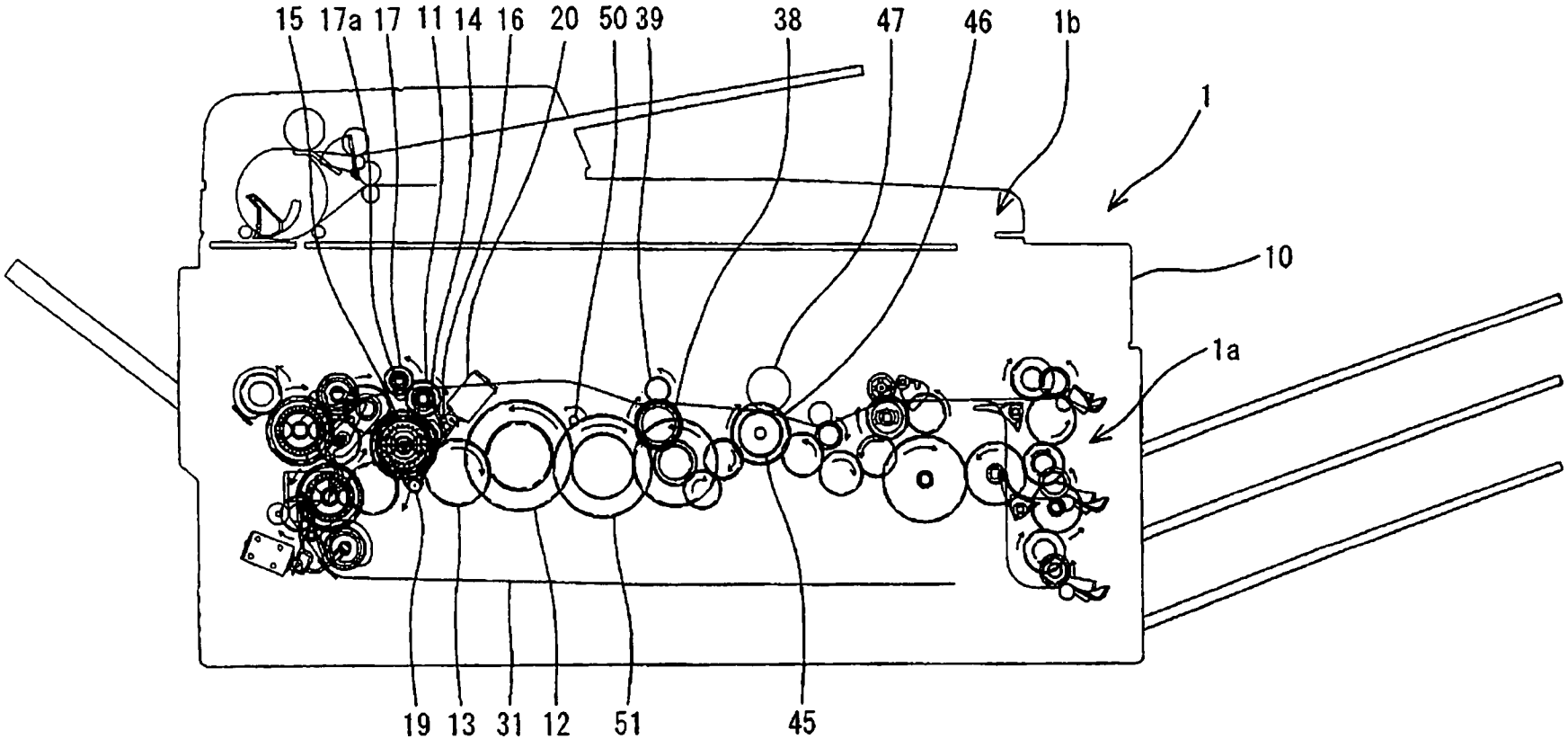
FIG. 2 is an overall view of a gear train in the image forming apparatus according to the embodiment of the present invention.
Figure 3:
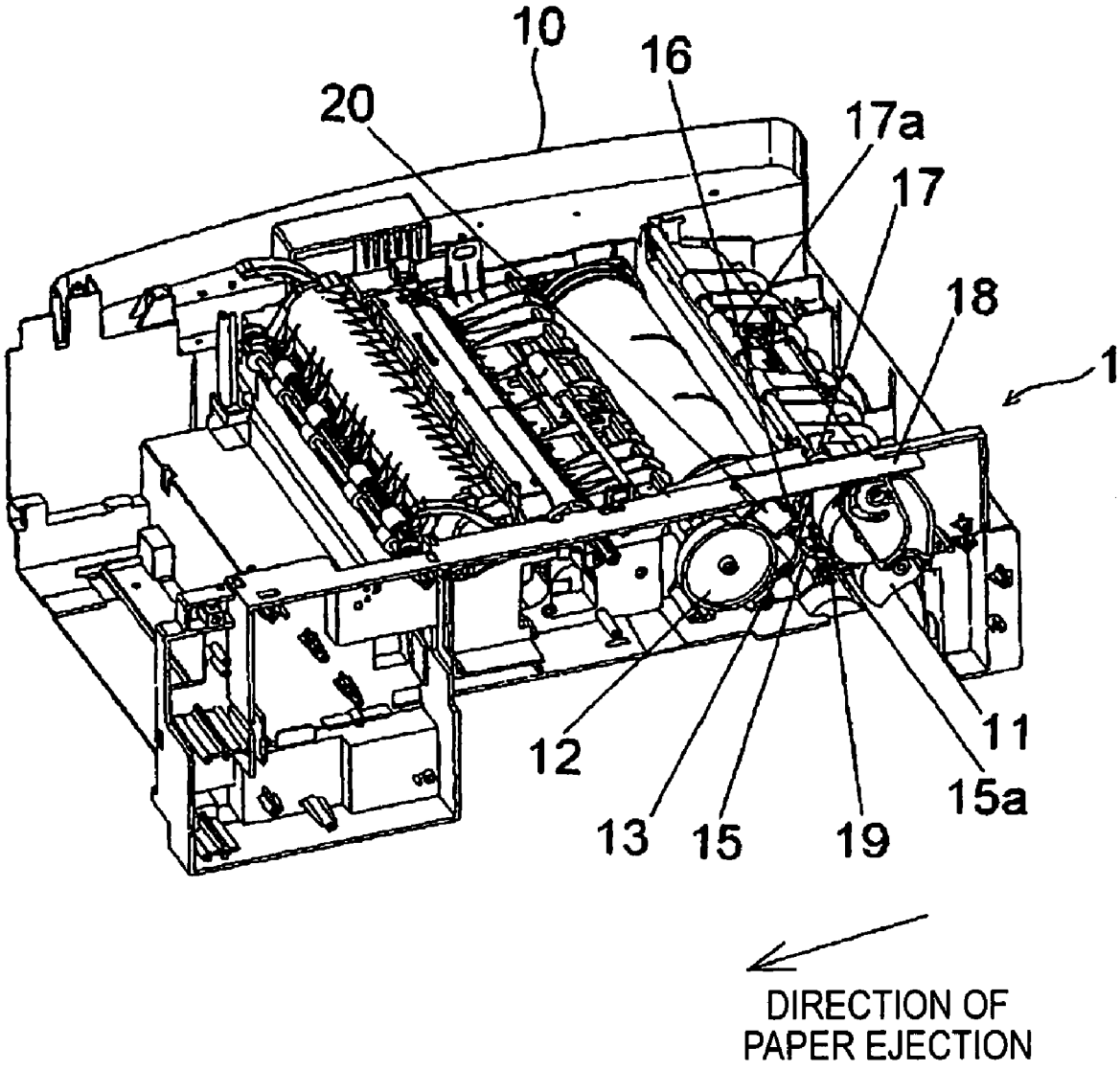
FIG. 3 is a perspective view illustrating an interior of the image forming apparatus according to the embodiment of the present invention.
Figure 4:
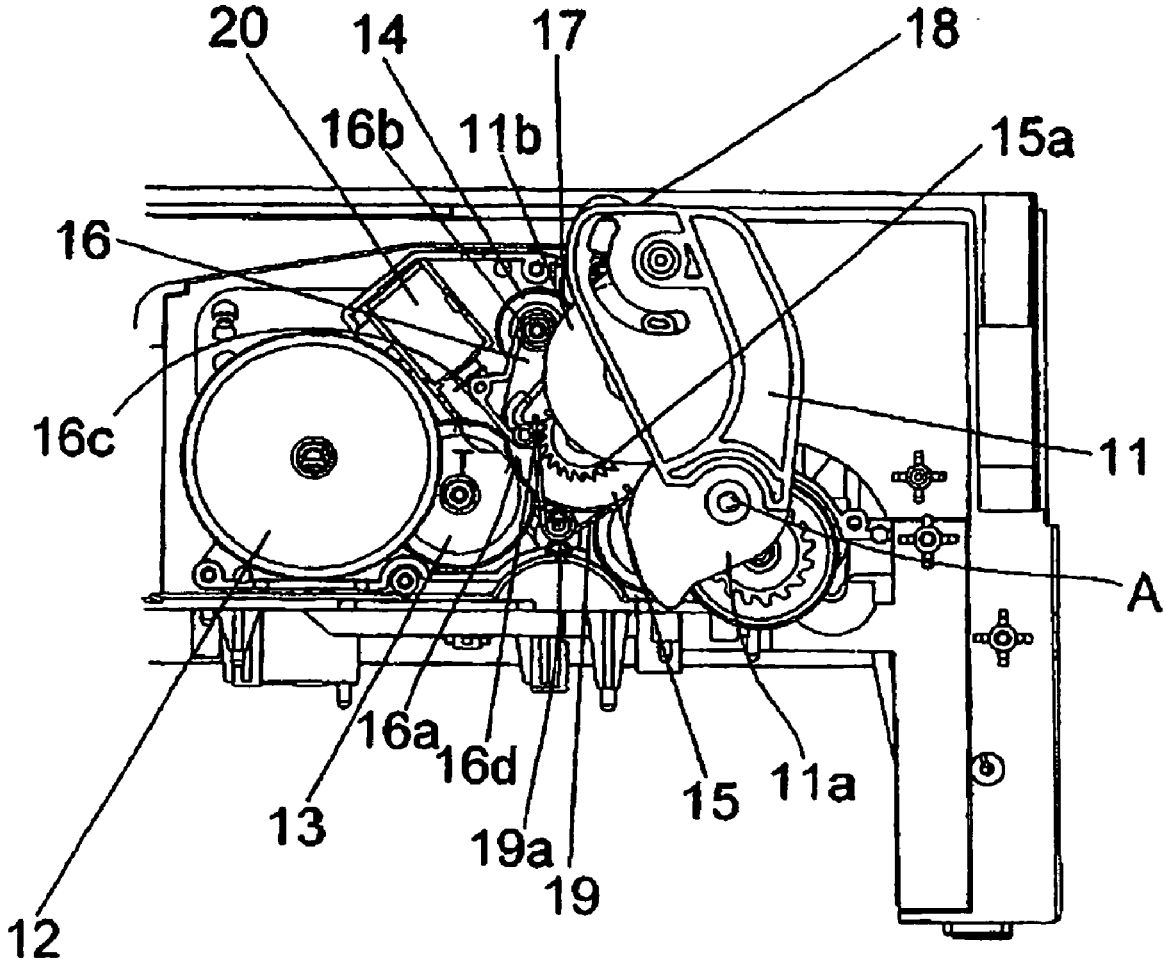
FIG. 4 is a side view illustrating the image forming apparatus according to the embodiment of the present invention when a cover is closed.
Figure 5:
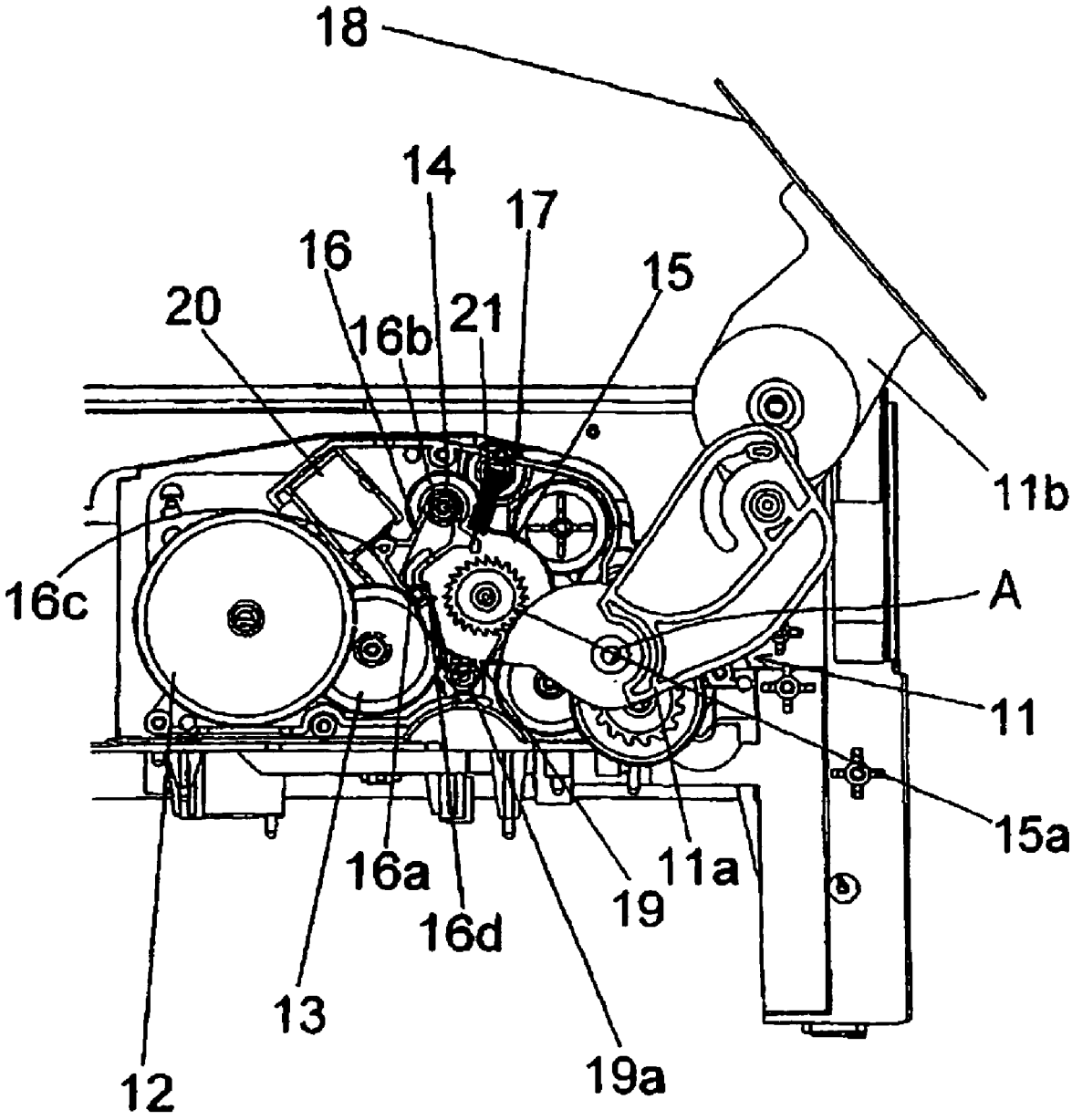
FIG. 5 is a side view illustrating the image forming apparatus according to the embodiment of the present invention when the cover is open.
Figure 6A:
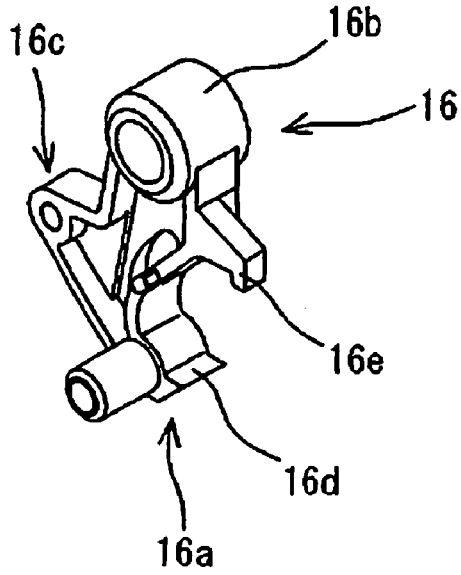
FIG. 6A is a perspective view illustrating a lever of the image forming apparatus according to the embodiment of the present invention.
Figure 6B:
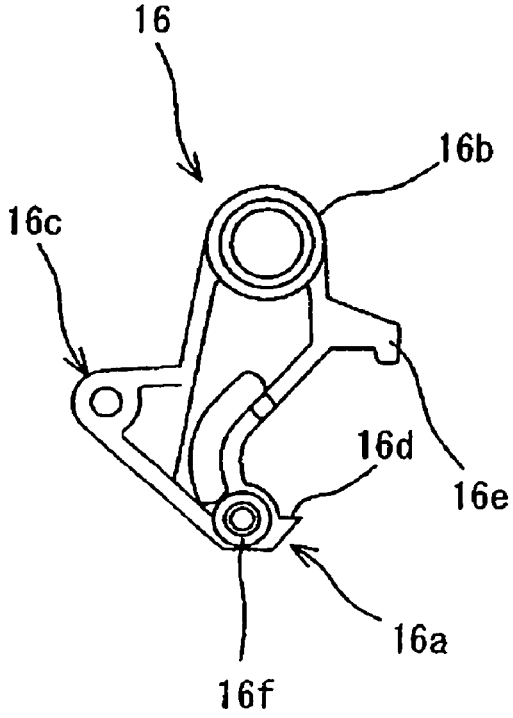
FIG. 6B is a front view of FIG. 6A.
Figure 6C:
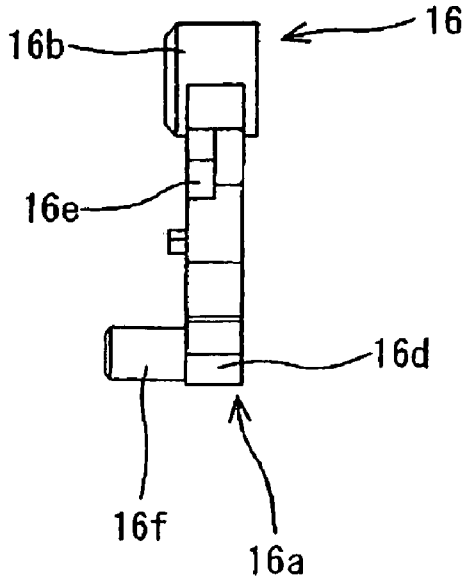
FIG. 6C is a side view of FIG. 6A.
Figure 7A:
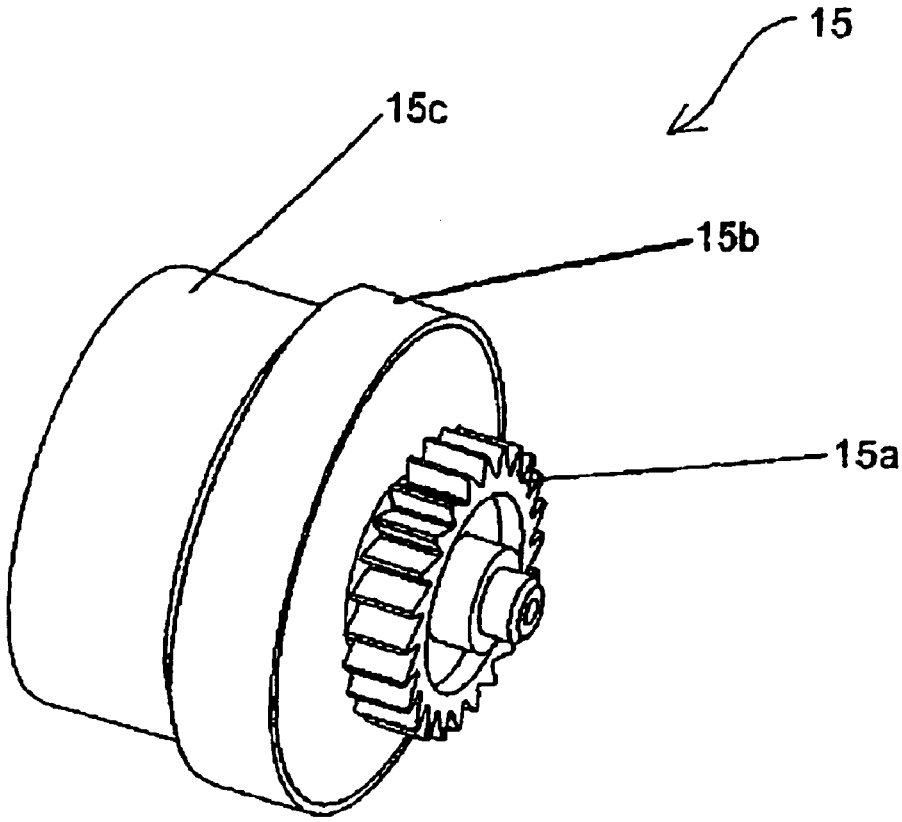
FIG. 7A is a perspective view illustrating a planetary gear mechanism of the image forming apparatus according to the embodiment of the present invention.
Figure 7B:
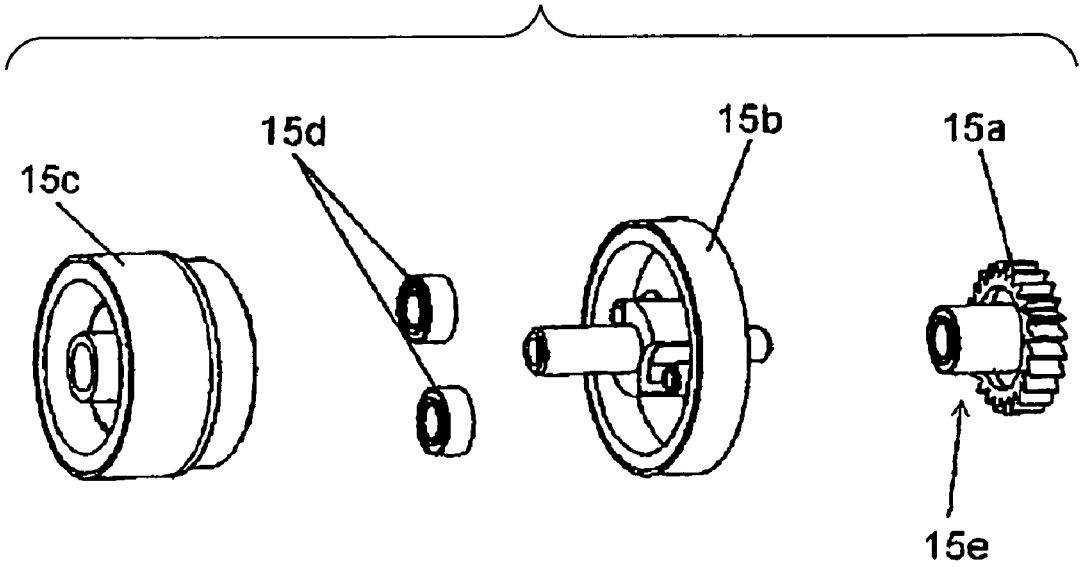
FIG. 7B is an exploded perspective view of FIG. 7A.
Figure 8A:
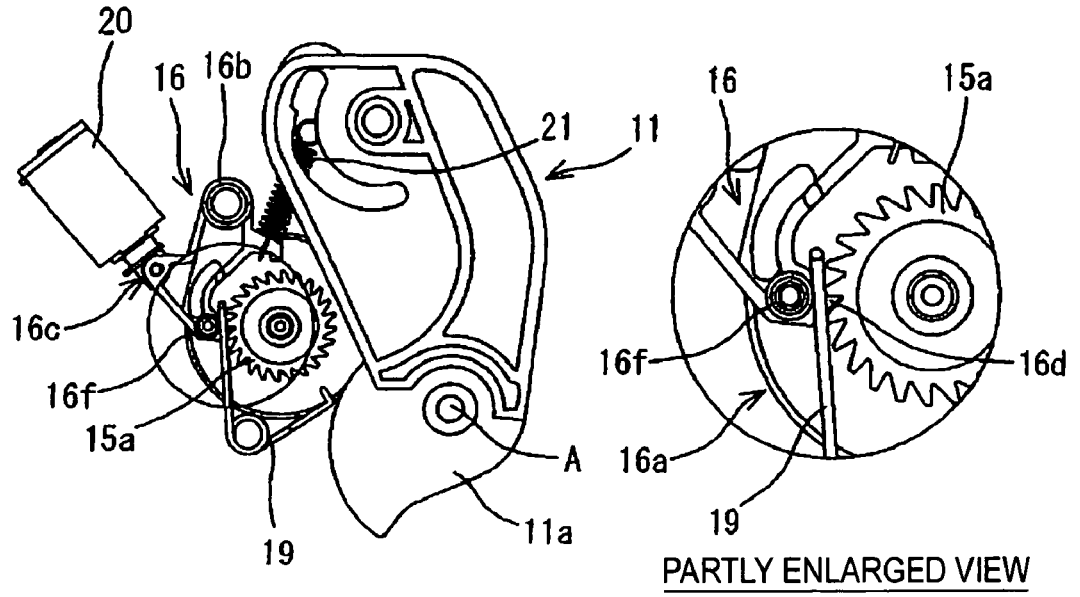
FIG. 8A illustrates an arm movement and an engaged ratchet gear when the cover is closed of the image forming apparatus according to the embodiment of the present invention.
Figure 8B:
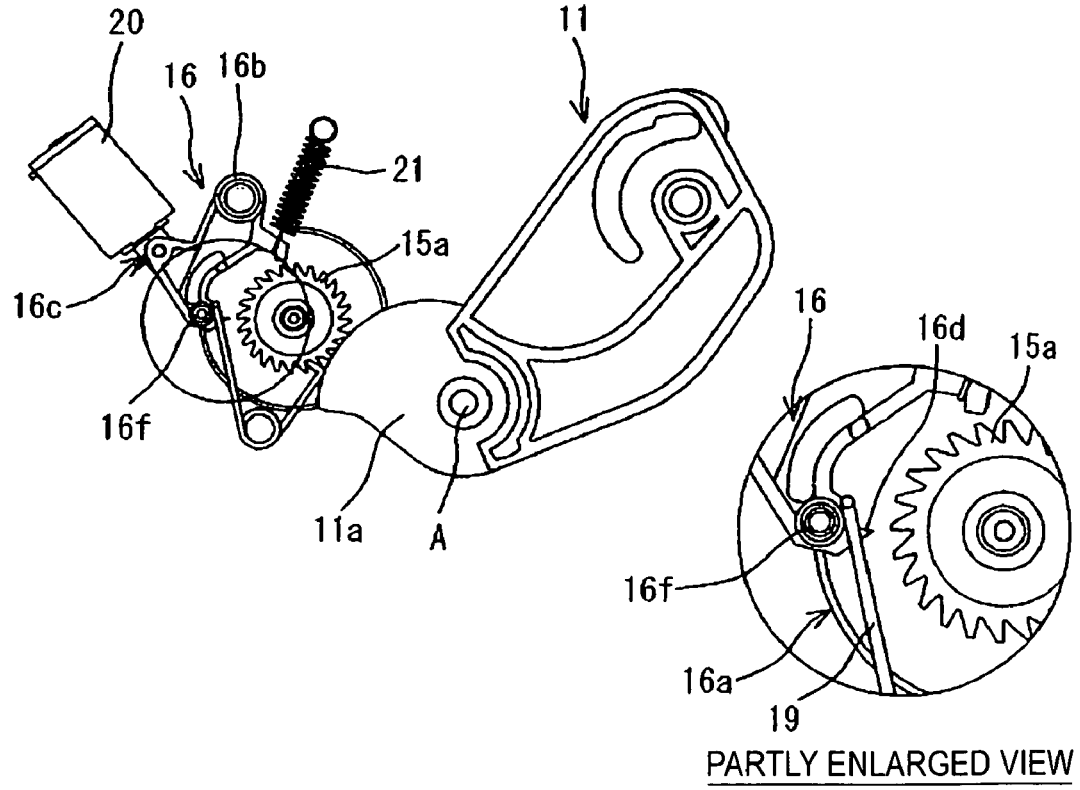
FIG. 8B illustrates the arm movement and the disengaged ratchet gear when the cover is open of the image forming apparatus of FIG. 8A.
Figure 9A:
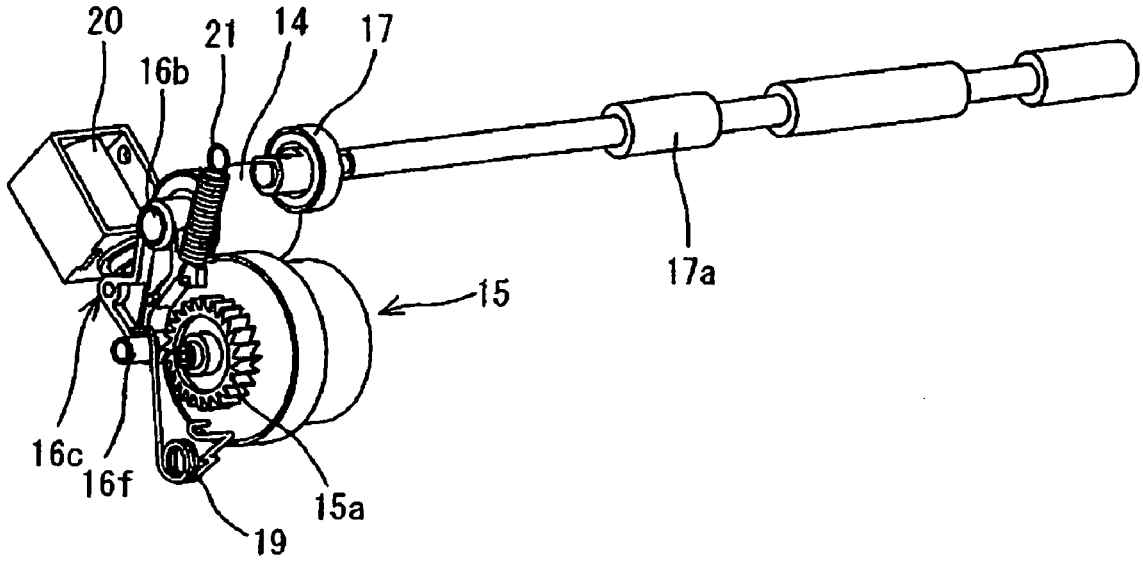
FIG. 9A illustrates a resist roller gear and the engaged ratchet gear when the cover is closed of the image forming apparatus according to the embodiment of the present invention.
Figure 9B:
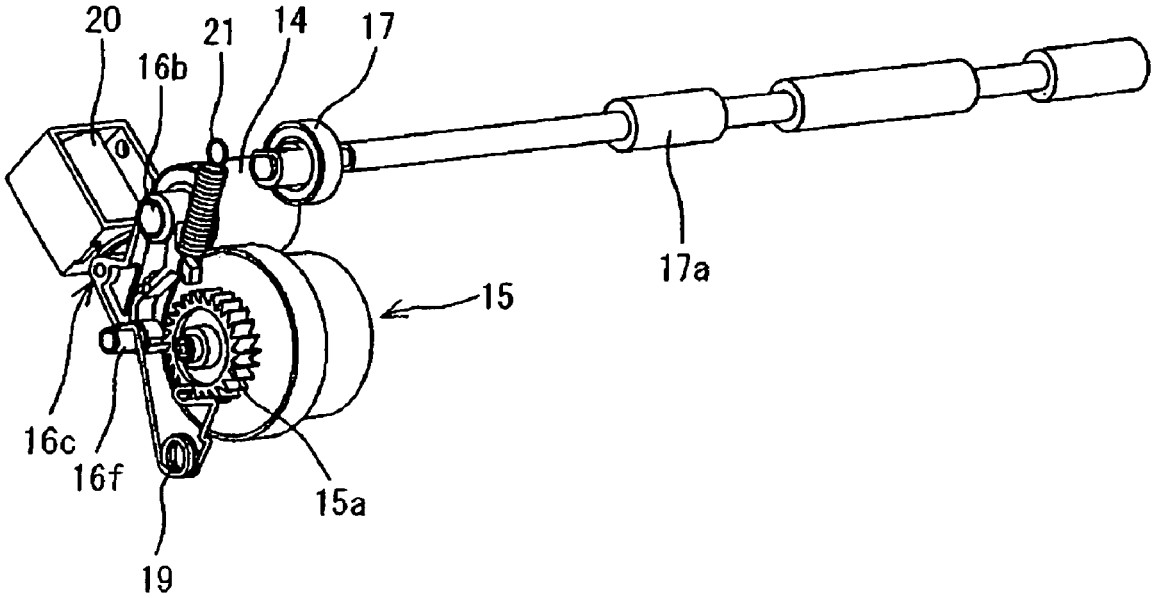
FIG. 9B illustrates the resist roller gear and the disengaged ratchet gear when the cover is open of the image forming apparatus of FIG. 9A.
Figure 10A:
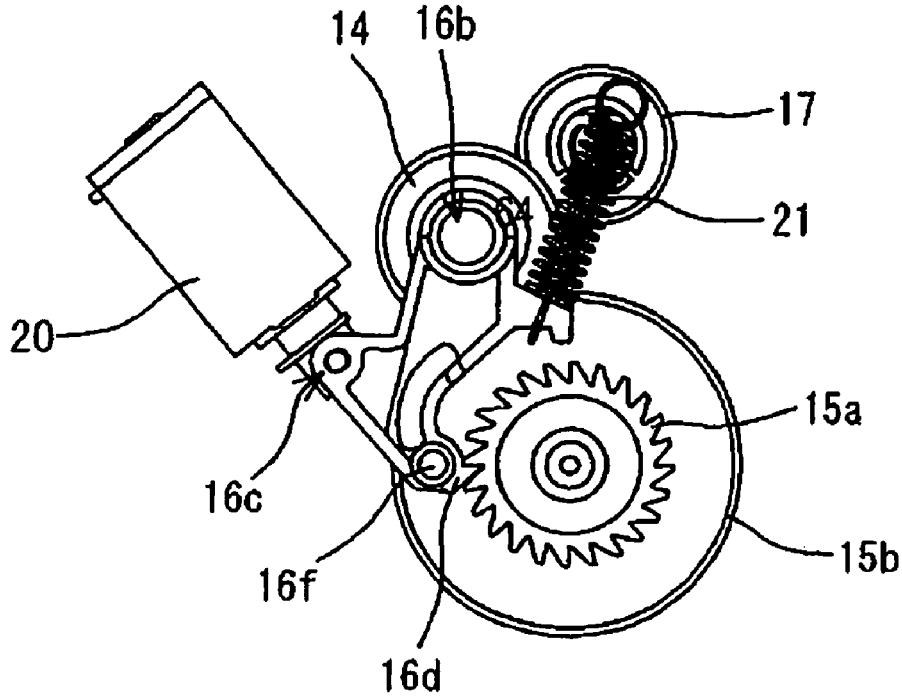
FIG. 10A illustrates a lever movement and the engaged ratchet gear when the cover is closed of the image forming apparatus according to the embodiment of the present invention.
Figure 10B:
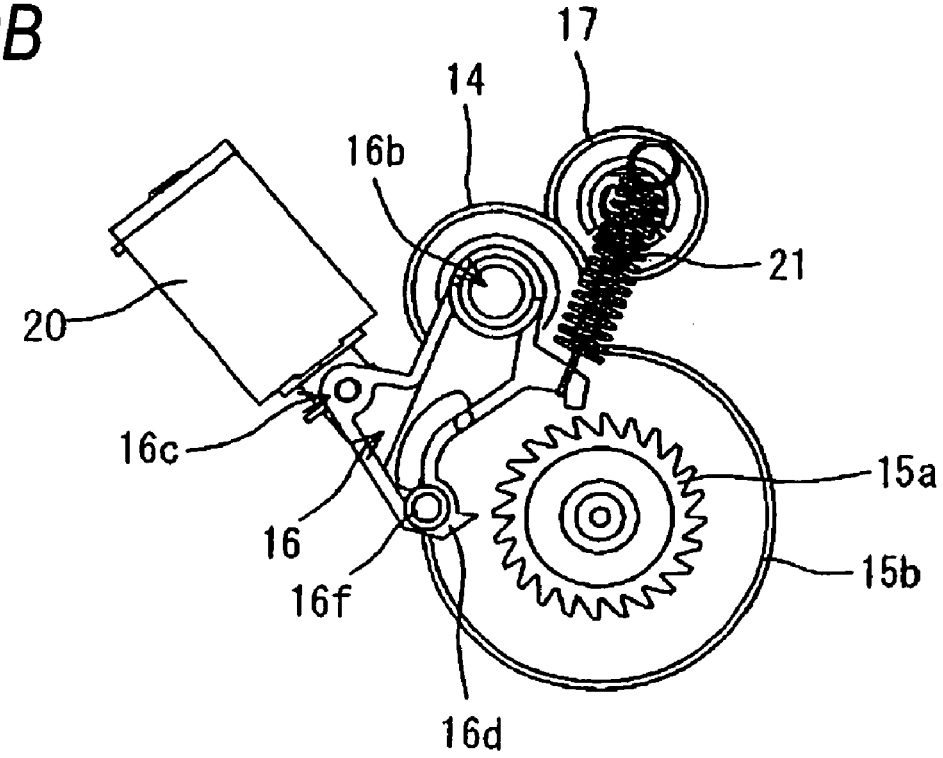
FIG. 10B illustrates the lever movement and the disengaged ratchet gear when the cover is open of the image forming apparatus of FIG. 10A.
Figure 11:
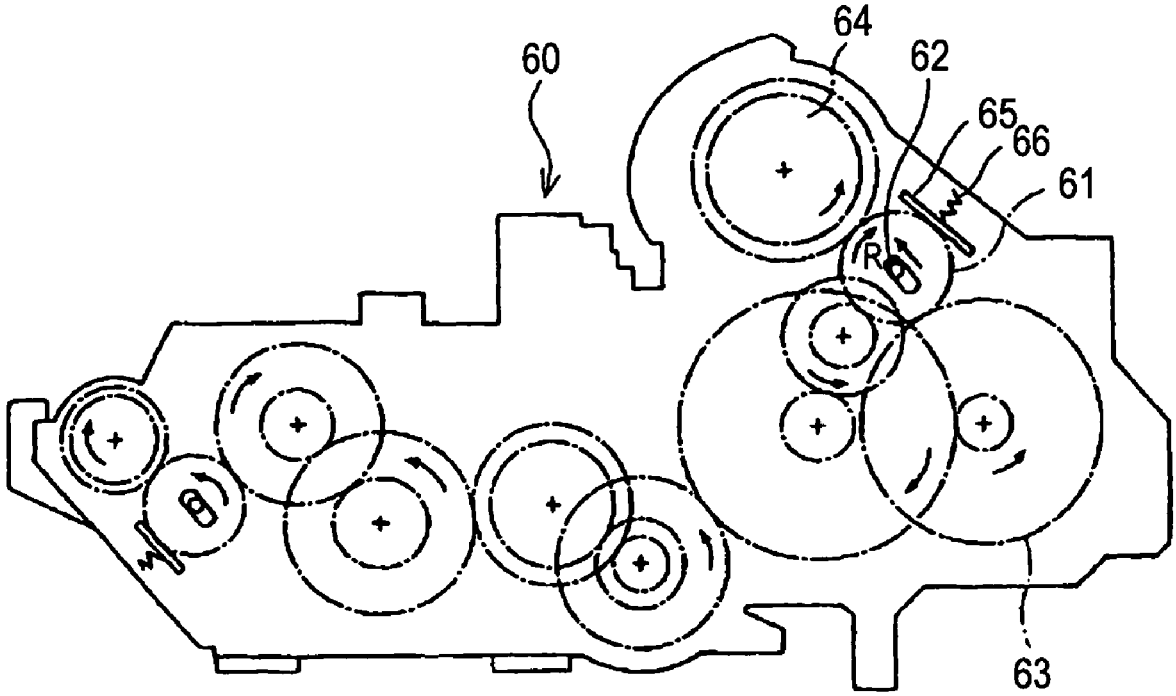
FIG. 11 illustrates meshing of a planetary gear in forward rotation in a driving unit as a conventional jam fixing measure.
Figure 12:
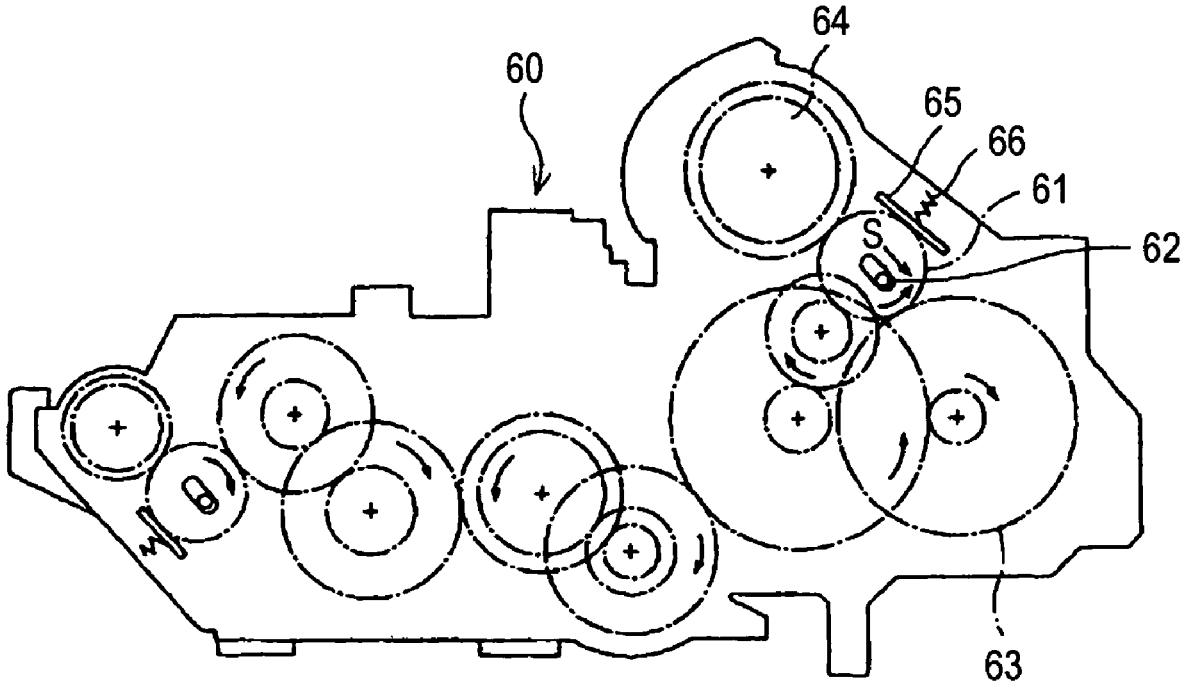
FIG. 12 illustrates meshing of the planetary gear in reverse rotation in the driving unit as the conventional jam fixing measure.

The embodiment of the present invention is explained in the following, with reference to the above-described drawings. FIG. 1 is a general overall view of a paper path in an image forming apparatus according to the embodiment of the present invention. FIG. 2 is an overall view of a gear train in the image forming apparatus according to the embodiment of the present invention. FIG. 3 is a perspective view illustrating an interior of the image forming apparatus according to the embodiment of the present invention. FIG. 4 is a side view illustrating the image forming apparatus according to the embodiment of the present invention when a cover is closed. FIG. 5 is a side view illustrating the image forming apparatus according to the embodiment of the present invention when the cover is open. FIG. 6A is a perspective view illustrating a lever of the image forming apparatus according to the embodiment of the present invention. FIG. 6B is a front view of FIG. 6A. FIG. 6C is a side view of FIG. 6A. FIG. 7A is a perspective view illustrating a planetary gear mechanism of the image forming apparatus according to the embodiment of the present invention. FIG. 7B is an exploded perspective view of FIG. 7A. FIG. 8A illustrates an arm movement and an engaged ratchet gear when a cover is closed of the image forming apparatus according to the embodiment of the present invention. FIG. 8B illustrates the arm movement and the disengaged ratchet gear when the cover is open of the image forming apparatus of FIG. 8A. FIG. 9A illustrates a resist roller gear and the engaged ratchet gear when the cover is closed of the image forming apparatus according to the embodiment of the present invention. FIG. 9B illustrates the resist roller gear and the disengaged ratchet gear when the cover is open of the image forming apparatus of FIG. 9A. FIG. 10A illustrates a lever movement and the engaged ratchet gear when the cover is closed of the image forming apparatus according to the embodiment of the present invention. FIG. 10B illustrates the lever movement and the disengaged ratchet gear when the cover is open of the image forming apparatus of FIG. 10A.

As shown in FIG. 1, image forming apparatus 1 according to the present embodiment has feeder mechanism 10 and cover 1*b*, which serves as a lid of feeder mechanism 10. Feeder mechanism 10 is provided with paper transport mechanism 1*a*. Pick up roller 33 feeds paper (a recording media of the present invention) from a standard cassette (not shown in the figure) to paper path 31. Jam sensor 34 then monitors a paper jam, and empty sensor 32 detects paper out and the like. When paper path 31 reverses a direction afterward, resist sensor 36 detects displacement of the paper, and resist roller 17*a* provides resistance to the paper so as to correct an edge position.

Paper top sensor 37 then detects the corrected paper edge, based on which an image is formed on a surface of photoconductor drum 38. The surface of photoconductor drum 38, which rotates in a direction of paper ejection, is charged by charger 41. On the charged surface, an electrostatic latent image is formed by laser scanning unit 49. On the electrostatic latent image formed on the surface of photoconductor drum 38, a visible image is then formed by development roller 40 with a toner supplied from toner cartridge 43. The visible image is transferred onto the paper by transfer roller 39, to which a high voltage is applied. The toner in toner cartridge 43 is supplied to development roller 40 by supply roller 42, and is mixed by internal mixing paddle 44. With the above-described configuration, image forming apparatus 1 turns the electrostatic latent image into the visible image.

The paper on which the image was transferred undergoes fixing process by heat roller 45 and pressure roller 47. The paper is then ejected on one of trays 48*a*, 48*b*, and 48*c*, through one path selected from a plurality of paths of paper path 31 based on an instruction from a controller (not shown in the figure).

Provided below is an overall description of a gear train that drives paper transport mechanism la of image forming apparatus 1, based on FIG. 2. Driving force from a driving motor (not shown in the figure) is transmitted to motor pinion 50 and then to adjacent first intermediate gear 51. Rotation of first intermediate gear 51 is transmitted to photoconductor drum 38 and transfer roller 39 in the direction of paper ejection, and at the same time to heat roller 45, heat roller gear 46, and the like via a large number of intermediate gears.

In an opposite direction to paper ejection, the rotation of first intermediate gear 51 is transmitted to planetary gear mechanism 15 via second intermediate gear 12 and third intermediate gear 13, and further to resist roller gear 17 in a normal state. When cover 1*b* is opened to fix a paper jam, however, a transmission path in planetary gear mechanism 15 is switched, and transmission of the driving force from the driving motor to resist roller gear 17 is temporarily suspended. Torsion spring 19 in FIG. 2 is used for switching the transmission path in planetary gear mechanism 15. An operational configuration of planetary gear mechanism 15, torsion spring 19, and the like will be described below.

Image forming apparatus 1 according to the present embodiment connects the driving motor and the plurality of gears described above, and thereby disposes the plurality of gears along the direction of paper ejection and drives the plurality of gears using one driving motor. The configuration sequentially outputs sheets of paper fed in the apparatus in the direction of paper ejection while requiring no more than one driving motor, and thus allows size reduction of image forming apparatus 1.

As shown in FIGS. 3 to 10, image forming apparatus 1 according to the present embodiment includes arm 11, planetary gear mechanism 15, resist roller gear 17, engaging portion 16*a*, and lever 16. Arm 11 supports cover 1*b* so that cover 1*b* can open and close, and swings (partially rotates) as cover 1*b* opens and closes. Planetary gear mechanism 15 is driven by the driving motor via the plurality of intermediate gears. Resist roller gear 17 rotates resist roller 17*a*, which provides resistance to the paper fed to feeder mechanism 10 so as to correct the paper edge position. Lever 16 is provided with engaging portion 16*a* being movable so as to engage with and to disengage from planetary gear mechanism 15. The driving force from the driving motor is transmitted to resist roller gear 17 as engaging portion 16*a* engages planetary gear mechanism 15.

Arm 11 connects to lever 16 via torsion spring 19, which is a link member. Arm 11 has rotation portion 11*a* that rotates on rotation axis A shown in FIGS. 4, 8A, and 8B; and supporting portion 11*b* that is rotatably connected to rotation portion 11*a*. Sequentially provided to supporting portion 11*b* is cover support 18, which supports cover 1*b* for opening and closing. Further, cover 1*b* is provided with an operation panel for operating image forming apparatus 1 according to the present embodiment.

FIGS. 7A and 7B illustrate planetary gear mechanism 15 of image forming apparatus 1 according to the embodiment of the present invention. FIG. 7A is a perspective view, and FIG. 7B is an exploded perspective view (tooth profiles of the gears partially omitted). As FIGS. 7A and 7B show, planetary gear mechanism 15 has gears 15*c*, 15*b*, and 15*e*; and planetary gears 15*d* and 15*g*. Gear 15*c* includes external gear 15*f* that connects to third intermediate gear 13, and internal gear 15*m* that engages planetary gears 15*d* and 15*g*. Further, gear 15*e* includes ratchet gear 15*a* capable of spinning only in one direction, and sun gear 15*j* that engages planetary gears 15*d* and 15*g*. Planetary gears 15*d* and 15*g*, which are rotatably supported on rotation axis 15*k* and 15*l* respectively, engage an internal circumference of internal gear 15*m* of gear 15*c* and sun gear 15*j* of gear 15*e* through slits provided on gear 15*b*. As external gear 15*f* of gear 15*c* connects to third intermediate gear 13, planetary gear mechanism 15 connects to the driving motor via in order of second intermediate gear 12 and first intermediate gear 51. Further, as gear 15*b* and fourth intermediate gear 14 are connected, the driving force from the driving motor is transmitted to resist roller gear 17.

A relationship of the number of teeth on the respective gears is configured as: (the number of teeth on internal gear 15*m*)=2×(the number of teeth on planetary gears 15*d* and 15*g*)+(the number of teeth on sun gear 15*j*). Further, the number of teeth on planetary gears 15*d* and 15*g* is formed same as that on sun gear 15*j* of gear 15*e*, though may not be necessarily the same when the above-described relationship is established. When the rotation is applied from third intermediate gear 13 to gear 15*e*, which is prevented from rotating by ratchet gear 15*a* (unrotatable state), planetary gears 15*d* and 15*g* orbit around sun gear 15*j* of gear 15*e* so as to rotate gear 15*b*. Thereby, the driving force from the driving motor is transmitted to fourth intermediate gear 14. On the other hand, when gear 15*e* is in freely rotatable state (i.e., ratchet gear 15*a* is detached from lever 16), planetary gears 15*d* and 15*g* only rotate on rotation axes 15*k* and 15*l* respectively, which are provided on gear 15*b*, and do not orbit around sun gear 15*j* of gear 15*e*. Therefore, no rotation driving force is transmitted to fourth intermediate gear 14, even when the rotation driving force is transmitted from third intermediate gear 13 to gear 15*c*.

As described above, planetary gear mechanism 15 has two kinds of transmission paths (transmission and suspension) for transmitting the driving force from the driving motor. To switch between the transmission paths (transmission and suspension), ratchet gear 15*a* is used to prevent gear 15*e* from rotating or to allow gear 15*e* to freely rotate. On the first transmission path, the driving force from the driving motor, which is transmitted to gear 15*c* of planetary gear mechanism 15 via first intermediate gear 51, second intermediate gear 12, and third intermediate gear 13, is further transmitted to resist roller gear 17 via planetary gears 15*d* and 15*g*, gear 15*b*, and then fourth intermediate gear 14, when gear 15*e* is prevented from rotating. On the second transmission path, the driving force from the driving motor is not transmitted to resist roller gear 17, since, as described later, disengaging pawl 16*d* of engaging portion 16*a* from ratchet gear 15*a* allows gear 15*e* to freely rotate, and thus planetary gears 15*d* and 15*g* rotate on the axes thereof and gear 15*b* does not rotate.

As shown in FIGS. 8A, 9A, and 10A, when pawl 16*d* (a description follows) of engaging portion 16*a* of lever 16 engages ratchet gear 15*a*, gear 15*e* is prevented from rotating. The driving force from the driving motor is thus transmitted from third intermediate gear 13 to gear 15*c*, further from planetary gears 15*d* and 15*g* to gear 15*b*, and then from fourth intermediate gear 14 to resist roller gear 17.

As shown in FIGS. 8B, 9B, and 10B, when pawl 16*d* of engaging portion 16*a* of lever 16 disengages ratchet gear 15*a*, the driving force from the driving motor is similarly transmitted in order of first intermediate gear 51, second intermediate gear 12, third intermediate gear 13, and gear 15*c* of planetary gear mechanism 15. However, disengaging engaging portion 16*a* of lever 16 from ratchet gear 15*a* allows gear 15*e* to freely rotate. Thereby, gear 15*b* stops rotating, and thus the driving force from the driving motor is not transmitted to fourth intermediate gear 14 and resist roller gear 17.

As shown in FIGS. 9A and 9B, resist roller gear 17 rotates or stops resist roller 17*a*. Stopping resist roller 17*a* from rotating provides resistance to the paper being fed in image forming apparatus 1 and corrects the paper edge so as to be in a right direction and at a right position. Then, rotating resist roller 17*a* again feeds the paper in feeder mechanism 10 in the direction of paper ejection.

As shown in FIGS. 6, 8A, 8B, 9A, 9B,10A, and 10B, lever 16 has a frame shape formed by deforming a lamellar member. Lever 16 includes: engaging portion 16*a* that connects to planetary gear mechanism 15; link 16*b* attached to an axis of fourth intermediate gear 14; moving portion 16*c*, to which solenoid 20 is attached with a spring pin so as to allow engaging portion 16*a* to engage with and to disengage from planetary gear mechanism 15; and latch 16*e* that hitches extension spring 21.

Engaging portion 16*a* of lever 16 is provided with pawl 16*d*, which engages and connects to ratchet gear 15*a* of planetary gear mechanism 15. Pawl 16*d* may have any shape that allows pawl 16*d* to engage a tooth on ratchet gear 15*a*. Further, engaging portion 16*a* is provided with boss 16*f* having a cylindrical shape, which is disposed so as to hitches one end of torsion spring 19. Lever 16 is smoothly pressured by the end of torsion spring 19, thus capable of enduring repetitive pressure.

A first method for disconnecting and connecting planetary gear mechanism 15 and resist roller gear 17 is to control disconnection and connection using solenoid 20, extension spring 21, and the like. When cover 1*b* is closed as shown in FIG. 4, magnetic force from a main body of solenoid 20, which is attached to moving portion 16*c* with the spring pin, pulls in a plunger of solenoid 20 and thus pulls moving portion 16*c* toward solenoid 20. Lever 16 then rotates on link 16*b* (rotation direction T in FIG. 4) while elastically deforming extension spring 21; detaches and disengages pawl 16*d* of engaging portion 16*a* from ratchet gear 15*a*; and disconnects from planetary gear mechanism 15. When solenoid 20 stops pulling in the plunger, moving portion 16*c* rotates on link 16*b* in a reverse direction of rotation direction T, due to elastic resilience of extension spring 21, and pawl 16*d* of engaging portion 16*a* easily engages ratchet gear 15*a*. Then, planetary gear mechanism 15 transmits again the driving force from the driving motor through resist roller gear 17 via fourth intermediate gear 14.

Image forming apparatus 1 according to the present invention rotates and stops resist roller 17*a* as described above. Thereby, image forming apparatus 1 provides resistance to the paper being fed therein, so as to correct and place the paper edge at the right position in the right direction, and to feed the paper in the direction of paper ejection.

Further, a second method for disconnecting and connecting planetary gear mechanism 15 and resist roller gear 17 is that an operator manually performs disconnection and connection using arm 11, torsion spring 19, and the like. As shown in FIGS. 4, 5, 8A, 8B, 9A, 9B, 10A, and 10B, torsion sprig 19 has a substantially L shape or a bent shape at an acute angle, having coil portion 19*a* at a center. One end portion of torsion spring 19 is disposed so as to contact rotation portion 11*a*, which is a semi-circled portion of arm 11. Another end portion of torsion spring 19 hitches into engaging portion 16*a*. The other portion may hitch when pressed by arm 11.

Both of the end portions or one of the end portions of torsion spring 19 is bent. Torsion spring 19 rotates on coil portion 19*a* so as to transmit a movement of arm 11 to engaging portion 16*a* of lever 16. That increases strength of coil portion 19*a* and allows even application of pressure for smooth operation. Specifically, when cover 1*b* is opened as shown in FIG. 5, arm 11 rotates on rotation axis A, and torsion spring 19 rotates on coil portion 19*a*, thereby disengaging pawl 16*d* of engaging portion 16*a* of lever 16 from ratchet gear 15*a*. In the process, arm 11 and lever 16 are temporarily disconnected.

Further, when cover 1*b* is closed as shown in FIG. 4, arm 11 similarly rotates on rotation axis A; torsion spring 19 rotates in the reverse direction on coil portion 19*a*; and extension spring 21 engages pawl 16*d* of engaging portion 16*a* of lever 16 and ratchet gear 15*a*. In the process, arm 11 and lever 16 are reconnected. Since the end portion of torsion spring 19 connects to engaging portion 16*a* of lever 16, as shown in FIGS. 4, 5, 8A, 8B, 9A, 9B, 10A, and 10B, torsion spring 19 of the present embodiment can be formed in a minimum size, compared to a case when the end portion thereof connects to a position on lever 16 other than engaging portion 16*a*.

Described below are procedures that the operator performs to fix a paper jam that occurs in image forming apparatus 1, with reference to FIGS. 3 to 10B.

As shown in FIG. 4, cover 1*b* is closed in a normal state of use. In the state, the driving motor starts operating and the driving force therefrom sequentially rotates the gears so as to feed the paper to a position of resist roller 17*a*. Then, the image forming apparatus pulls moving portion 16*c* using the magnetic force from the main body of solenoid 20; rotates lever 16 on link 16*b* (rotation direction T in FIG. 4); and releases pawl 16*d* of engaging portion 16*a* from ratchet gear 15*a* so as to disengage from planetary gear mechanism 15. The driving force from the driving motor is then transmitted to gear 15*c* of planetary gear mechanism 15, via first intermediate gear 51, second intermediate gear 12, and third intermediate gear 13. Since pawl 16*d* of engaging portion 16*a* and ratchet gear 15*a* have disengaged, however, gear 15*e* rotates and gear 15*b* does not rotate. Thereby, fourth intermediate gear 14 stops rotating, so does resist roller gear 17. As described above, temporarily stopping the rotation of resist roller gear 17 provides resistance to the paper being fed in the image forming apparatus and corrects the edge position of the paper. When the paper edge position is corrected, the main body of solenoid 20 stops pulling and the elastic resilience of extension spring 21 swiftly re-engages pawl 16*d* and ratchet gear 15*a*. Then, the driving force from the driving motor is transmitted through resist roller gear 17 via fourth intermediate gear 14, and the paper is fed in the direction of paper ejection.

When the paper is jammed in resist roller 17*a* while being fed in the direction of paper ejection due to a certain cause, image forming apparatus 1 notifies the operator using a method not shown in the figure, so that the operator opens cover 1*b* of feeder mechanism 10 of image forming apparatus 1 in order to fix the paper jam. When the operator opens cover 1*b*, arm 11 rotates on rotation axis A; torsion spring 19 rotates on coil portion 19*a*; and pawl 16*d* of engaging portion 16*a* of lever 16 and ratchet gear 15*a* thus disengage, as shown in FIG. 5. Thereby, the driving force from the driving motor is not transmitted to resist roller gear 17 as described above, thus allowing the operator to rotate resist roller 17*a* with no load applied from the driving motor and to gently pull the jammed paper out for removal. When the operator pulls the jammed paper, resist roller 17*a* rotates, thus causing the rotation from resist roller gear 17 to fourth intermediate gear 14 and to gear 15*b* and planetary gears 15*d* and 15*g* of planetary gear mechanism 15. However, the operator is not required to pull with a substantial force since no load is applied from the driving motor as described above.

In image forming apparatus 1 of the present embodiment, simply opening cover 1*b* allows the operator to rotate resist roller gear 17 with no load applied from the driving motor. Thereby, the operator can easily remove the jammed paper in image forming apparatus 1, by gently pulling the paper without performing extra operation. Further, simply opening cover 1*b* disengages engaging portion 16*a* of lever 16 and ratchet gear 15*a* of planetary gear mechanism 15. Thus, even when image forming apparatus 1 is turned off due to an operator's operation error, power cut, and the like, the operator can easily remove the jammed paper in image forming apparatus 1 by gently pulling the paper.

Lever 16 according to the present embodiment does not necessarily have the above-described shape, but may have any shape that enables the above-described functions. Further, it is possible to design a desired number of gears disposed between the driving motor and planetary gear mechanism 15 or a desired number of gears between lever 16 and resist roller gear 17.

The image forming apparatus of the present invention thus allows the operator to easily remove the jammed paper by simply opening the cover thereof without performing extra operation.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application Nos. 2005-142658 filed on May 16, 2005, and 2006-72346 filed on Mar. 16, 2006, entire content of which is expressly incorporated by reference herein.

What is claimed is:

1. An image forming apparatus comprising:

an arm that supports a cover, the cover opening and closing with respect to the image forming apparatus;

a first spring that has feet at both ends thereof;

a resist roller that corrects an edge position of a recording media for forming an image on the recording media;

a first gear that receives rotation from a driving motor;

a second gear that is provided on the same axis as an axis of the first gear, the second gear transmitting the rotation to the resist roller by the rotation of the first gear;

a third gear that includes a ratchet gear provided on the same axis as the axis of the first gear;

a planetary gear that rotates while engaging with the first and second gears; and a lever that has a boss and a pawl, the boss engaging one end foot of the first spring, the pawl engaging the ratchet gear to link the first and second gears;

wherein when the cover is opened, the arm presses the other end foot of the first spring, the first spring rotates, the one end foot of the first spring presses the boss of the lever to rotate the lever, and the pawl of the lever detaches from the ratchet gear to rotate the second gear independently from the first gear, the transmission of the rotation from the second gear to the resist roller being disconnected.

2. The image forming apparatus according to claim 1, wherein the lever includes a latch to which a solenoid is attached.

3. The image forming apparatus according to claim 1, wherein the lever has a frame shape.

4. The image forming apparatus according to claim 1, wherein the arm has a semicircular shape at a portion against which the one foot of the first spring is pressed.

5. The image forming apparatus according to claim 1, wherein the boss has a cylindrical shape.

6. The image forming apparatus according to claim 1, wherein one of the both end feet and the one end foot of the first spring has a bent shape.

7. The image forming apparatus according to claim 1, further comprising a return spring that returns the lever to an original position when the cover is closed, wherein the lever has a latch to which the return spring locks.

8. An image forming apparatus comprising:

an arm that supports a cover, the cover opening and closing with respect to the image forming apparatus;

a first spring that has feet at both ends thereof;

a resist roller that corrects an edge position of a recording media for forming an image on the recording media;

a first gear that receives rotation from a driving motor;

a second gear that is provided on the same axis as an axis of the first gear, the second gear transmitting the rotation to the resist roller by the rotation of the first gear;

a third gear that includes a ratchet gear provided on the same axis as the axis of the first gear;

a planetary gear that rotates while engaging with the first and second gears; and a lever that has a boss and a pawl, the boss engaging one end foot of the first spring, when the pawl engages the ratchet gear to prevent the third gear from rotating, the rotation of the first gear being connected with the second gear and the planetary gear being rotated around an axis of the first gear as a center, and when the pawl detaches from the ratchet gear to allow the third gear to rotate, the rotation of the first gear being disconnected from the second gear and the planetary gear being rotated on an axis thereof by;

wherein when the cover is opened, the arm presses the other end foot of the first spring, the first spring rotates, the one end foot of the first spring presses the boss of the lever to rotate the lever, and the pawl of the lever detaches from the ratchet gear to rotate the second gear independently from the first gear, transmission of the rotation from the second gear to the resist roller being disconnected.

9. The image forming apparatus according to claim 8, wherein the lever includes a latch to which a solenoid is attached.

10. The image forming apparatus according to claim 8, wherein the lever has a frame shape.

11. The image forming apparatus according to claim 8, wherein the arm has a semicircular shape at a portion against which the one foot of the first spring is pressed.

12. The image forming apparatus according to claim 8, wherein the boss has a cylindrical shape.

13. The image forming apparatus according to claim 8, wherein one of the both end feet and the one end foot of the first spring has a bent shape.

14. The image forming apparatus according to claim 8, further comprising a return spring that returns the lever to an original position when the cover is closed, wherein the lever has a latch to which the return spring locks.

15. An image forming apparatus comprising:

a paper path that feeds a recording media;

an image forming unit that forms an image on the recording medium being fed on the paper path;

a cover that opens and closes when the recording medium is jammed in a roller on the paper path;

an arm that swings as the cover opens and closes;

a lever that locks a ratchet gear provided to a planetary gear mechanism unit when the arm swings; and a spring that transmits a swing of the arm to the lever, wherein when the cover is closed, driving force from a driving motor is transmitted to the roller via the planetary gear mechanism unit, when the cover is opened, the driving force is not transmitted to the roller, as locking the ratchet gear switches a transmission path of the driving force in the planetary gear mechanism unit, and the planetary gear mechanism unit comprises a first gear to which the driving force from the driving motor is transmitted, a second gear that transmits the driving force to the roller, a planetary gear provided between the first and second gears, the ratchet gear, and a third gear that transmits the driving force from the first gear to the second gear via the planetary gear when the ratchet gear is locked by the lever and unable to rotate, and that allows the planetary gear to rotate on an axis thereof so as to disconnect the transmission of the driving force to the roller when the ratchet gear is not locked and capable of freely rotating.

* * * * *